US008114265B2

(12) United States Patent
Berriah et al.

(10) Patent No.: US 8,114,265 B2
(45) Date of Patent: Feb. 14, 2012

(54) EFFICIENCY OPTIMIZATION AND DAMAGE DETECTION OF ELECTROLYSIS CELLS

(75) Inventors: Said Berriah, Laval (CA); Michel Veillette, St-Bruno (CA); Gilles J. Tremblay, Montréal (CA)

(73) Assignee: Recherche 2000 Inc., Montreal, Quebec (CA)

( * ) Notice: Subject to any disclaimer, the term of this patent is extended or adjusted under 35 U.S.C. 154(b) by 917 days.

(21) Appl. No.: 12/136,905

(22) Filed: Jun. 11, 2008

(65) Prior Publication Data

US 2009/0014326 A1 Jan. 15, 2009

Related U.S. Application Data

(60) Provisional application No. 60/943,188, filed on Jun. 11, 2007.

(51) Int. Cl.
*C25B 15/06* (2006.01)
*C25B 15/02* (2006.01)

(52) U.S. Cl. ..... 205/337; 205/335; 205/775; 205/791.5; 204/401; 204/228.1; 204/228.6; 204/229.8; 204/230.2; 204/230.5; 324/500; 324/509; 324/510; 324/511; 324/512; 324/522; 324/523; 324/531; 324/537; 324/750.01; 324/750.3

(58) Field of Classification Search ..... 205/791.5, 205/775, 335, 337; 204/401, 228.1, 228.6, 204/229.8, 230.2, 230.5; 324/416, 500, 509, 324/510, 511, 512, 522, 523, 531, 537, 750.01, 324/750.3

See application file for complete search history.

(56) References Cited

U.S. PATENT DOCUMENTS 3,644,190 A * 2/1972 Weist et al. ..... 204/228.1
7,122,109 B2 * 10/2006 Rantala et al. ..... 205/337

* cited by examiner

*Primary Examiner* — Bruce Bell
(74) *Attorney, Agent, or Firm* — Norton Rose Canada LLP

(57) ABSTRACT

There is described a method and a system for evaluating damage of a plurality of cells in an electrolyser. The method comprises acquiring a voltage for each one of the cells; comparing the voltage to at least two threshold voltage levels; classifying the cells as one of: severely damaged cells, non-severely damaged cells and undamaged cells, based on the comparison of the voltage with the at least two threshold voltage levels; and deactivating the cells classified as severely damaged cells from the electrolyser.

22 Claims, 13 Drawing Sheets

EFFICIENCY OPTIMIZATION AND DAMAGE DETECTION OF ELECTROLYSIS CELLS

CROSS-REFERENCE TO RELATED APPLICATIONS

This application claims priority under 35US §119(e) of U.S. provisional patent application 60/943,188 filed on Jun. 11, 2007 and entitled "METHOD AND SYSTEM FOR ELECTROLYSIS CELLS EFFICIENCY OPTIMIZATION AND DAMAGE DETECTION", the specification of which is hereby incorporated by reference.

FIELD OF THE INVENTION

The present description relates to methods and systems for monitoring electrolyser efficiency, for diagnosing and evaluating damage as well as for providing maintenance data to improve efficiency.

BACKGROUND OF THE ART

Electrolysers are used to perform electrolysis reactions, which either decompose a chemical compound into its elements or produces a new compound, through the action of an electrical current. Electrolysers have a number of electrodes, anodes and cathodes, each separated by a separator such as a membrane. The separator is however optional, as seen in the Chlorate industry, where Sodium Chlorate or Sodium Hypochlorite is produced from the electro-generated chlorine and caustic.

Other examples of electrolysers are fuel cells, where water is electrolysed to produce Hydrogen.

The Chlor-alkali industry also employs electrolysers. The primary products of the electrolysis reaction in such a case are Chlorine, Hydrogen, and Sodium Hydroxide. These compounds are usually in a solution which is commonly called "caustic soda" or simply "caustic".

Three main electrolysis processes exist and are known as: the membrane process, the diaphragm process and the mercury process. Current trends along with growing environmental concerns are replacing the latter families of processes with the membrane electrolysis process. Chlor-alkali production plants commonly use electrolysers which combine many elementary membrane cells. In a bipolar configuration, for example, the electrolysis process takes place in each elementary cell after applying a current. For many reasons, such as to control the electrolyser's energy consumption and to maximize the production rate, it is desirable to maintain and attempt to improve the electrolyser's efficiency.

While it is possible to measure parameters at the elementary cell level, there is a need for carefully controlling several operational aspects of each elementary cell to determine its respective efficiency and to evaluate its respective damage. There is also a need for determining appropriate maintenance actions on each cell based on an entire electrolyser configuration and efficiency behaviour.

SUMMARY

The present description discloses a method and system for evaluating single element optimum production efficiency and detecting membrane damages in electrolysis elementary cells installed in a bipolar electrolyser under real operation conditions. This method comprises the detection of elementary cells with damage in their ion exchange membrane and the identification of cells with lower current efficiency. While such a diagnosis is accomplished, better overall electrolysis efficiency can be achieved through rearranging the cells in the electrolyser to new positions which are dependant on the estimated efficiency of each cell.

According to an embodiment, there is provided herein a method for evaluating damage of a plurality of cells in an electrolyser, the method comprising: acquiring a voltage for each one of the cells; comparing the voltage to at least two threshold voltage levels; classifying the cells as one of: severely damaged cells, non-severely damaged cells and undamaged cells, based on the comparison of the voltage with the at least two threshold voltage levels; and deactivating the cells classified as severely damaged cells from the electrolyser.

According to another embodiment, there is provided herein a system for evaluating damage of a plurality of cells in an electrolyser, the system comprising: a voltage acquisition device coupled to each one of the cells in the electrolyser, for acquiring a voltage for each one of the cells; and a damage evaluation module coupled to the voltage acquisition device, the damage evaluation module adapted to receive the voltage acquired for each one of the cells; compare the voltage to at least two threshold voltage levels; classify the cells as being one of: severely damaged cells, non-severely damaged cells and undamaged cells, based on the comparison; and send a signal to deactivate the cells classified as severely damaged cells.

In the present specification, the term "cell" (also referred to as "elementary cell") is intended to refer to the smallest group of anodes and cathodes that are connected to the same current feeder and separated by a membrane. It is to be noted that the words "cell" and "element" are used interchangeably in the present description. The ways the anodes, cathodes and membrane are connected differ according to the selected technology. For example, the electrodes can be connected in parallel, in series or a combination thereof. A "bipolar electrolyser" has a plurality of cells.

DETAILED DESCRIPTION

Figure 1A:
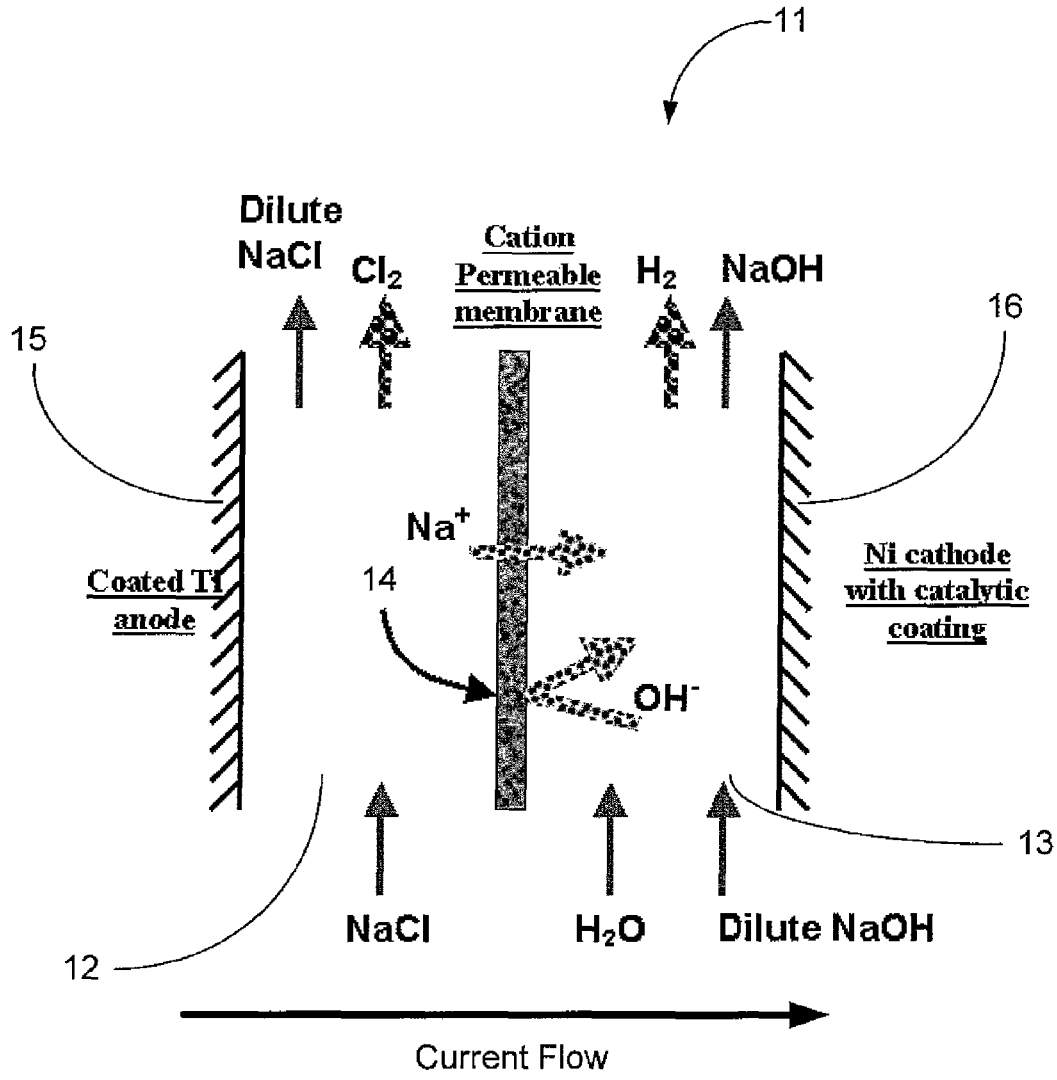
FIGURE 1a PRIOR ART
FIG. 1*a* is a schematic exemplary representation of a membrane cell in accordance with the prior art.

FIG. 1*a* is a schematic representation of a typical membrane cell 11 used in the Chlor-alkali industry. It is composed of two compartments, an anode compartment 12 and a cathode compartment 13, separated by a membrane 14. The anode compartment 12 is filled-up with a saturated brine solution (NaCl), while a dilute caustic soda passes through the cathode compartment 13.

In Chlor-alkali production plants, Chlorine is generated at the coated anode 15 (usually with Titanium). The combination of Hydroxide ions with migrated Sodium ions across the selective membrane 14 generates caustic soda (NaOH) and Hydrogen gas. The cathode 16 is usually made of Nickel with a catalytic coating to reduce the over-potential for $H_2$ evolution. The complete Chlor-Alkali process is described by the following equation:

$$2NaCl+2H2O \rightarrow Cl2+H2+2NaOH \quad (1)$$

The efficiency of membrane-type Chlor-Alkali cell (kw/h per unit of caustic produced) is a complex resultant of the interaction of a number of aspects. This includes cell design, transport characteristics of the membrane 14, the concentration, pH, temperature and flow rate, or residence time, of the anolythe brine and catholyte caustic solution within the cell and the cell current and voltage. While a number of these factors are essentially fixed once the cell is assembled and placed into operation, others primarily related to the electrical and mass flow aspects, are capable of considerable changes and efficiency loss during cell operation. Whenever such changes occur, it is preferable to correct them as quickly as possible if the system is to be restored to the level of optimum efficiency with minimum cost.

One type of damage which causes a drop in cell efficiency is the occurrence of holes or tears in the cell membrane (herein referred to as pinholes). Some reasons for the presence of pinholes and pores in the cell membrane are the formation of voids, blisters, and delaminating of the membrane due to faults in start-ups and shutdowns and by contaminated electrolytes.

The presence of pinholes in the membrane, for example, can affect the cell's efficiency in different ways depending on the pinhole(s)'s size and location (in a part of the cell where there is the liquid or in another part of the cell where only gas is present), as well as the age of the cell. Usually, pinhole effects are not detectable at normal operation phase unless corrosion has taken place in the anode coating due to the attack of caustic soda. Pinhole effects are however noticeable at start-up of the electrolyser because caustic penetrating the membrane and flowing toward the anode at this time causes a water splitting reaction in the alkaline solution of the cell.

The presence of a water splitting reaction can be detected using various techniques, such as by detecting the reversible or characteristic voltage of the water splitting reaction, which is typically about 1.2 Volts to 1.5 Volts at low current densities (i.e. smaller than 3 kA/m2). This is in contrast with voltages detectable when the normal sodium chloride splitting reaction takes place as it should in the anode compartment of the cell, which is 2.2 Volts to 2.6 Volts at current densities of up to 0.3 kA/m2 (at a temperature of 80 C.° for example).

Other techniques can be used to detect the water splitting reaction, such as the detection of Oxygen evolution at the anodic compartment from a pH measurement of the cell. Such a measurement can be used to detect the Oxygen evolution since when Oxygen is present in the anodic compartment, the cell becomes highly pH-dependent in comparison to Chlorine evolution which takes place in relatively undamaged cells.

Even in the presence of pinholes in the membrane, as the current density increases in the cell, small pores get absorbed due to gas turbulence in the cell, Hypochlorite forms from the back-migrating caustic, and Oxygen evolution caused by the pinholes is progressively replaced by Chlorine evolution. If still at higher current densities, the cell voltage remains low compared to expected voltage levels, and the size of the membrane pinhole can be estimated to be large in size.

Caustic penetrating the anodic compartment through pinholes in the membrane has effects on the cell's efficiency. Since new membrane cells have an efficiency of about 98%, an estimation of the efficiency of each single elementary cell can be obtained by comparing each damaged membrane cell to new or nominal ones.

In accordance with the above principles, there is described herein a method and system for diagnosing low efficiency and damaged elementary cells installed in a bipolar electrolyser. Other types of electrolysers as well as fuel cells can also be diagnosed using the method and system described herein. In some embodiments, the method and system may be provided online.

Figure 1B:
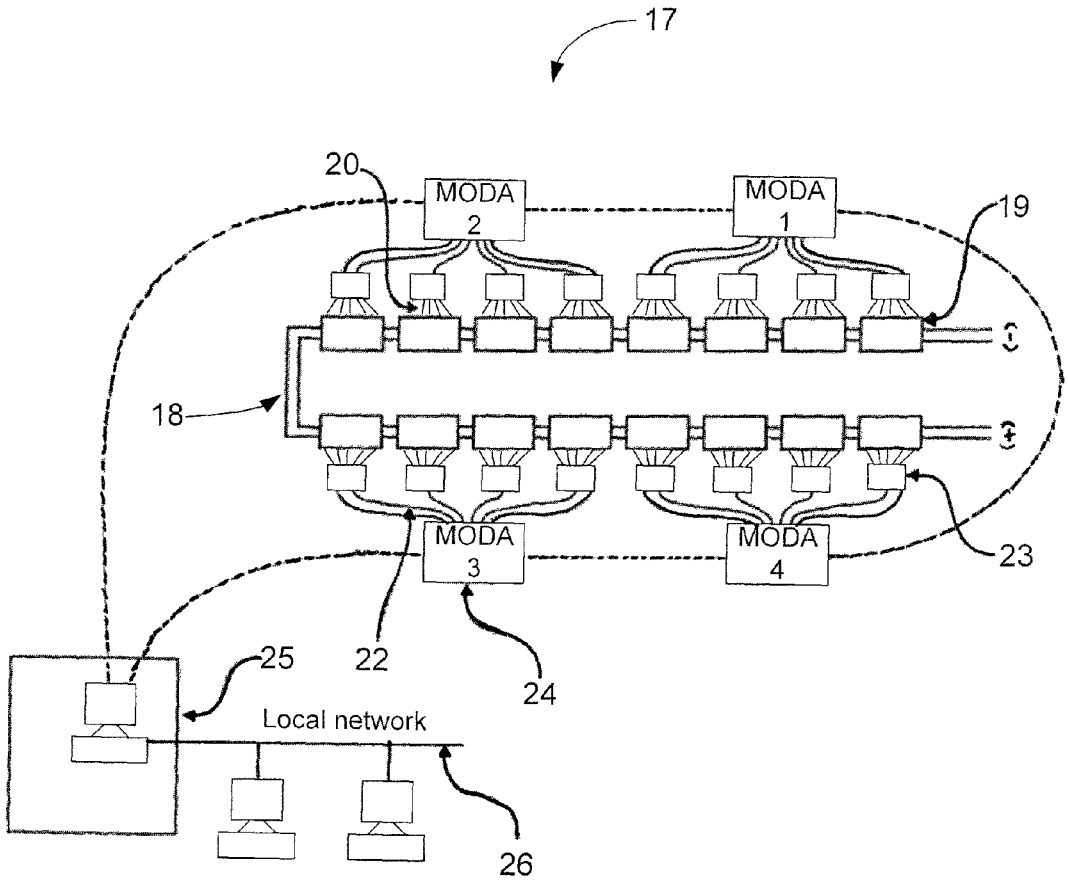
FIGURE 1b PRIOR ART
FIG. 1*b* is a schematic exemplary representation of an electrolyser having multiple cells in accordance with the prior art.

For explanatory purposes, FIG. 1*b* illustrates a common electrolyser 17 arrangement in which a production line 18 has a number of cell groupings 19; each cell grouping 19 contains eight elementary cells 11 (not shown). Each electrode voltage is measured by a metal wire 20. The wires 20 can be concentrated in a multi-cable protected cable 22 through a TFP10 (Terminal Fuse Protection 10) device 23. An acquisition device 24 can thus be used to acquire data from four cell groupings 19 for example. In this example, each acquisition device 24 can multiplex the signals from each cell grouping 19 by a series of relays, in a sequence for transmission to a personal computer 25 optionally connected in a local network 26, and in accordance with a given communication setup.

Figure 2:
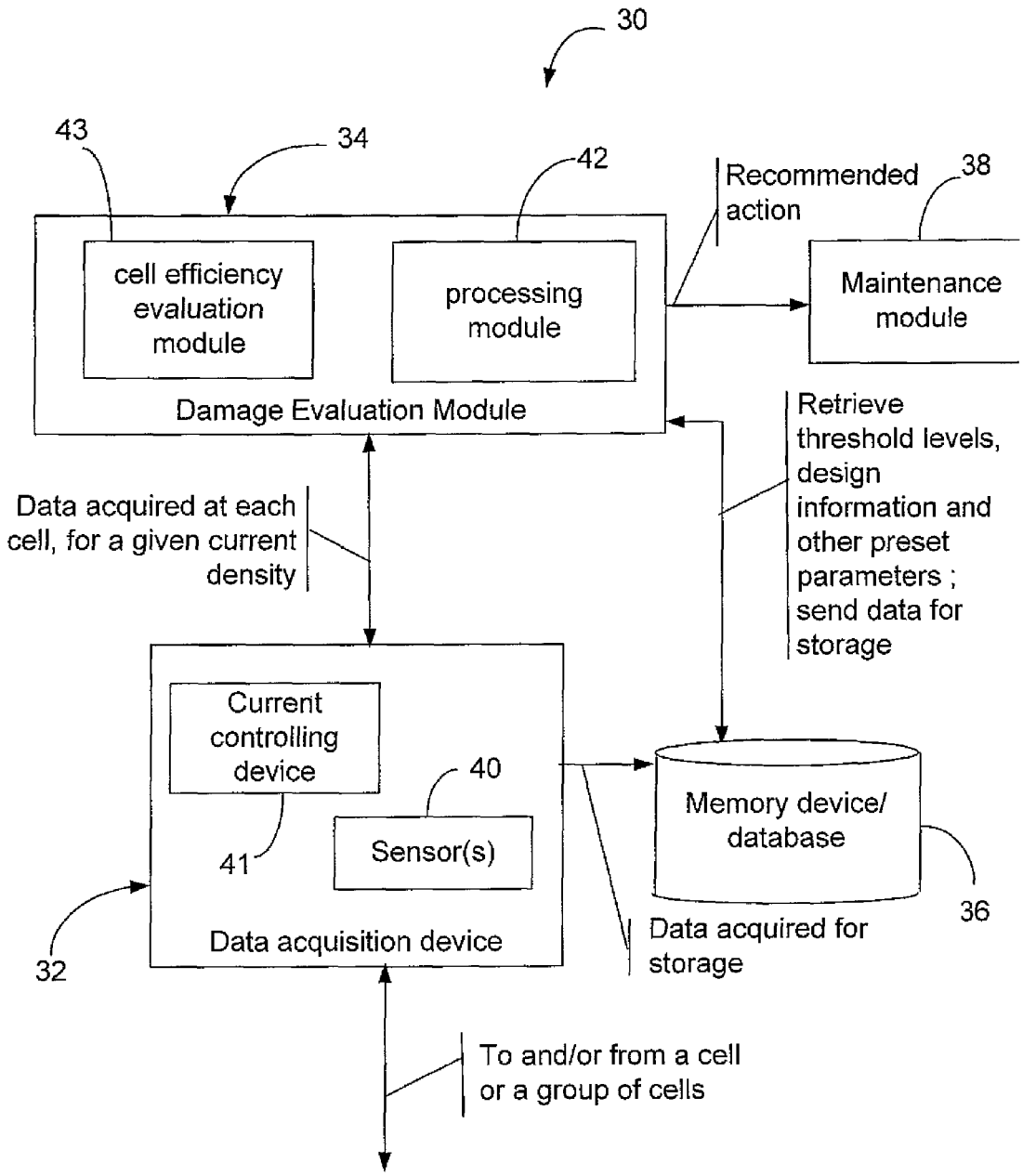
FIG. 2 is a block diagram of a system for evaluating damage of a plurality of cells in an electrolyser, in accordance with an embodiment of the present invention.

FIG. 2 illustrates a schematic example of a system 30 for evaluating damage of a plurality of cells in an electrolyser in accordance with one embodiment.

The system 30 has a data acquisition device 32 for measuring a voltage or other physical parameters of each elementary cell; a damage evaluation module 34 for monitoring the data acquired from each cell in the electrolyser and estimating a damage level; a memory device 36; and a maintenance module 38.

The memory device 36 is may be used to store the data acquired, laboratory or plant information, including any parametric or design data pertaining to the electrolyser or to the cells, such as preset threshold levels, in an embodiment where such storing is desired.

In one embodiment, a maintenance module 38 can be used to output or to perform directly on each cell or on the electrolyser maintenance actions. Maintenance actions depend on the damage evaluation. An example is a rearrangement of the cells within the electrolyser, a deactivation of damaged cells, a replacement of damaged cells with new ones, or an addition of cells in the electrolyser if possible. Alternatively to outputting a maintenance action, the system 30 can output an alarm or set-off a trigger mechanism that notifies a technician of a situation.

The data acquisition device 32 has one or more sensors 40 for acquiring data from a cell 11 (refer to FIG. 1*a*), as well as a current controlling device 41. The sensors 40 can be voltage sensors, pressure sensors, temperature sensors, liquid and flow sensors, sensors capable of detecting a type of pH of a solution inside a cell or the presence of a given compound in the cell, etc. Other types of physical parameters can also be used, such as current sensors and the like. The current controlling device 41 can be used to vary the current density passing in the cell so as to increase the current supplied to a cell from zero, through a polarization level, and up to a given optimum value at startup, or back to zero for a shutdown operation, in one embodiment.

The damage evaluation module 34 has processing module 42 and a cell efficiency evaluation module 43. The processing module 42 ensures the implementation of the method for evaluating damage of cells in the electrolyser.

The damage evaluation module 34 classifies the cells as undamaged, severely damaged and non-severely damaged, in order to take appropriate actions.

The cell efficiency evaluation module 43 is optional and performs an evaluation of the efficiency of each cell classified as non-severely damaged to determine how to maximize the overall efficiency of the electrolyser. Undamaged cells can also be evaluated for their efficiency.

The damage evaluation module 34 can have an application (not shown) with coded instructions which are used by the processing device 42 and the cell efficiency evaluation module 43 to perform a method such as detailed herein. Maintenance actions or any type of result obtained by the damage evaluation module 34 may be outputted to the maintenance module 38, or to any other output device (not shown) to notify a user of a given condition.

Figure 3A:
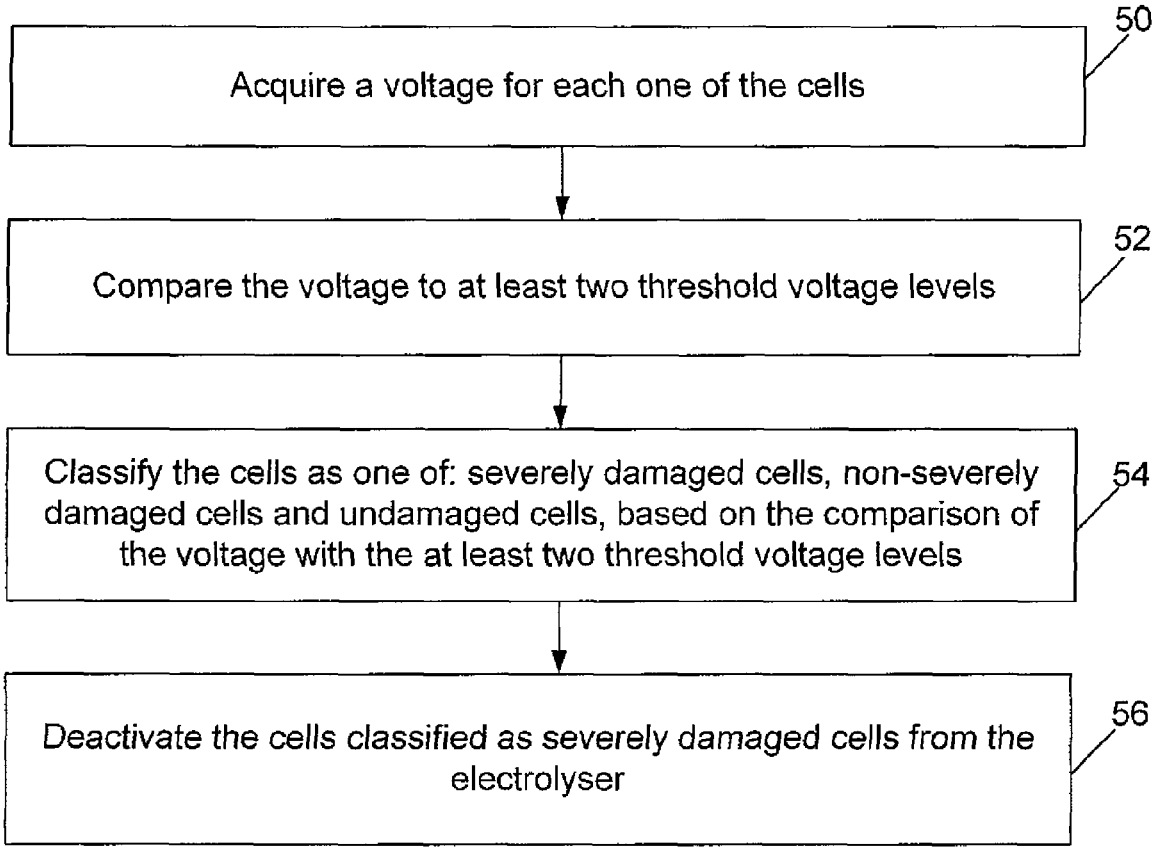
FIG. 3*a* is a flow chart of a method for evaluating damage of a plurality of cells in an electrolyser, in accordance with an embodiment.
Figure 3B:
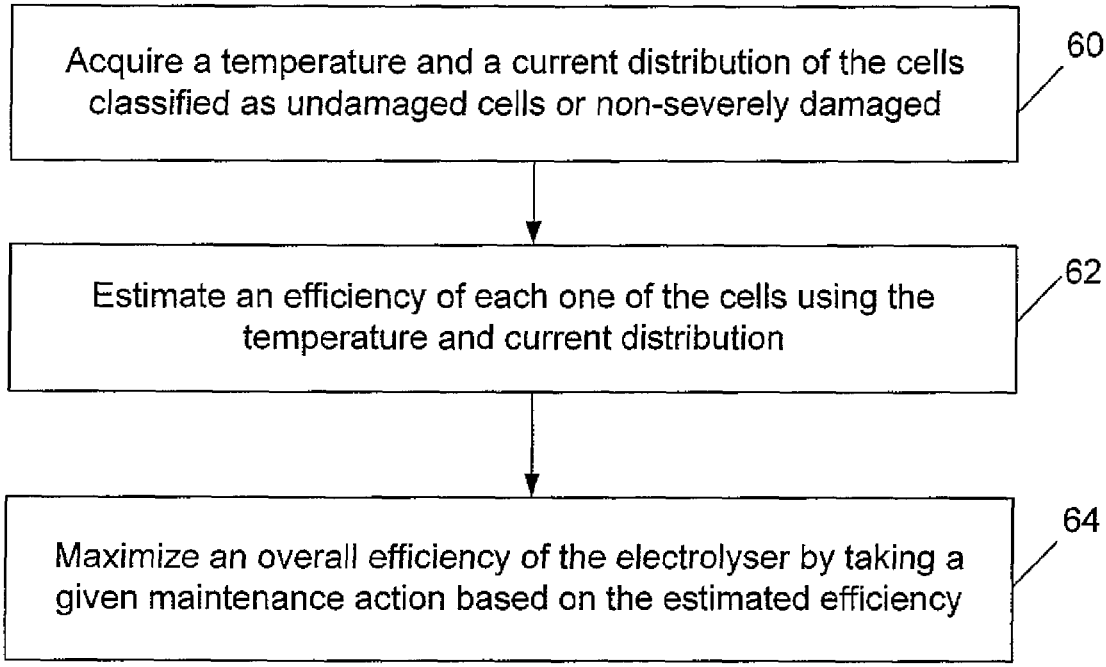
FIG. 3*b* is a flow chart of a method for estimating cell efficiency and maximizing an overall efficiency of an electrolyser, in accordance with an embodiment.

FIGS. 3*a* and 3*b* are flow charts of an embodiment of the method described herein.

In step 50 of FIG. 3*a*, voltages at each cell in the electrolyser are measured while a given current density passes through each cell.

In an embodiment, the cell voltages and currents are measured using the system outlined in U.S. Pat. No. 6,591,199 issued to Recherche 2000 Inc, the contents of which are hereby incorporated by reference. Any other measurement system having a measurement precision (at least 1 mV) and a sampling frequency which are suitable for acquiring measurements with high enough precision can also be used.

Other relevant parameters can also be measured in step 50, by using other types of sensors which are either not associated to a specific cell, such as production plant sensors, or directly related to physical or chemical parameters of a single cell in the electrolyser. An acquisition unit can be used to implement step 50 and the production plant sensors located at different positions in the electrolyser can communicate to the acquisition unit using a communication protocol as detailed in the aforementioned U.S. Pat. No. 6,591,199.

In step 52, the voltage acquired for each cell is compared to at least two threshold voltage levels for a given current density. Each one of the two threshold voltage levels are indicative of a voltage value for which a cell is to be classified as being below, above or at the critical level.

In step 54, the cells are classified as one of: severely damaged cells, non-severely damaged cells and undamaged cells, based on the comparison of the voltage with the at least two threshold voltage levels.

In step 56, the cells classified as severely damaged cells are deactivated from the electrolyser. This step can be done by removing the cells that are classified as such altogether, or replacing them with new ones.

As an example for the above steps 54 and 56, if the voltage of a cell is below a minimum threshold voltage (Vmin), it is no longer operative and too severely damaged (the output voltage is too low for the given current density). If the voltage of the cell is at Vmin, the cell is at a critical level and can either be classified as severely damaged or non-severely damaged. Either further assessment is required, or the cell is simply classified as severely damaged for safety reasons.

Otherwise, if the cell is damaged but still usable, its voltage is between the two threshold voltage levels, whereas if the cell is likely to be undamaged, its voltage is above the highest threshold voltage level (Vdamage). A cell which has a voltage at Vdamage can either be classified as undamaged or non-severely damaged. Further assessment as to its efficiency can be used to establish its classification. The cell is classified as one or the other, or as non-severely damaged if safer monitoring is preferred.

A list of cells is established, with a respective classification. A list of cells which are likely to have membrane damage but which are evaluated as not being very severely damaged is outputted, and a list of normal or undamaged cells is produced. The list may specifically identify the cells in accordance with its position in the electrolyser. An identification of the severely damaged calls is also outputted such that these may be deactivated, removed, replaced or accessed for maintenance.

The method optionally progresses to steps 60, 62 and 64 of FIG. 3*b*. These steps can also be performed independently of the method of FIG. 3*a*.

In step 60, a temperature and a current distribution of the cells classified as undamaged cells or non-severely damaged cells are acquired. This can be done using temperature sensors located at the cells, or throughout the electrolyser.

In step 62, an efficiency of each one of the cells is estimated using the temperature and current distribution.

In one embodiment, an estimation of an elementary cell efficiency takes into account temperature fluctuations that may occur throughout the electrolyser, especially at low current densities.

Step 62 can involve comparing each cell's estimated efficiency to a nominal efficiency provided by the supplier to identify elements/cells that affect the overall electrolyser's performance. The nominal efficiency can also be provided by estimating the efficiency of a new cell. Age of the cell can also be taken into consideration in estimating its efficiency. For example, an expected fall in the efficiency of a cell occurs along the life of a cell. A cell efficiency which is found to be lower than a value expected for the age of the cell can indicate that the cell has been suddenly damaged and a cause can be determined with correlation of the timing of other events in the electrolyser.

In step 64, the overall efficiency of the electrolyser can be maximized by taking a given maintenance action based on the estimated efficiency of each cell in step 62. One way of optimizing the overall electrolyser's power consumption, for example, is to move at least one of the cells to a new position in the electrolyser.

One example is to reposition a cell having a high estimated efficiency in order to compensate for a cell having a lower estimated efficiency. Low efficiency cells could be, for example, reassembled at extremities of the electrolyser, where temperature is typically slightly lower than in the middle positions, or repositioned in the electrolyser, with cells having similar levels of efficiency. Since the temperature distribution of the electrolyser may differ depending on its design, other repositioning schemes can be used. Further analysis may be performed to estimate the costs and/or gains of repositioning the cells compared to keeping the cells in their original positions.

Figure 3C:
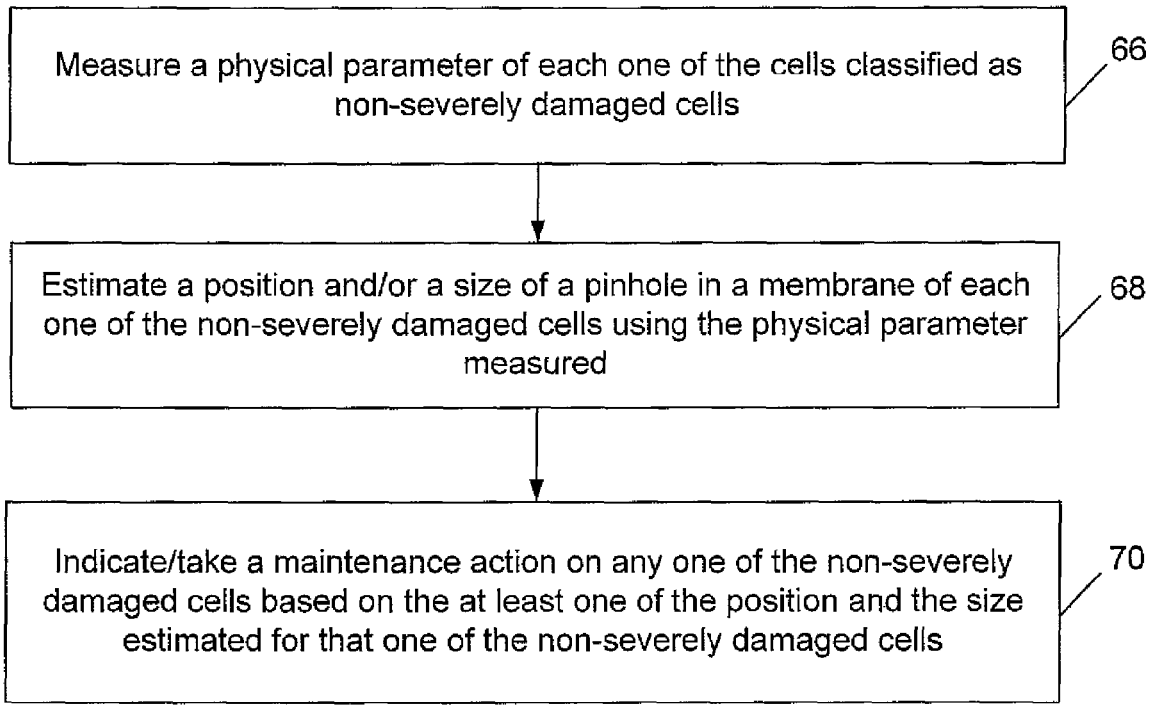
FIG. 3*c* is a flow chart of a method for estimating a pinhole size and position in a non-severely damaged cell to take a maintenance action, still in accordance with an embodiment.

The method of FIG. 3*a* can also optionally progress to steps 66, 68 and 70 of FIG. 3*c*.

In step 66, a physical or chemical parameter of each one of the cells classified as a non-severely damaged cell is measured and acquired. A physical parameter includes, but is not limited to, a temperature, an amount of liquid or gas inside the cell, a differential pressure, a caustic flow (or any flow of a given liquid), and the presence of a given compound. Parameters of undamaged cells can also be acquired.

In step 68, a position and/or a size of a pinhole in a membrane of each one of the non-severely damaged cells is estimated using the physical parameter measured. This step can however be performed for all the cells active in the electrolyser.

Step 68 can involve applying a non-linear parametric regression to the current versus voltage curve acquired in step 50 of FIG. 3*a*. The curve can be regressed using a parametric equation of the form:

$$V=A*\exp(CD)+B*\exp(-CD)+C \quad (2)$$

where A, B, D C are regression parameters or constants; CD refers to a current density and V is the voltage at the cell.

Other parametric equations can be used, such as logarithmic or sigmoid form. Nonlinear regression parameters can also be used to reflect the degree/amount of caustic flow penetrating the anodic compartment.

The regression parameters are correlated with the physical or chemical parameters measured in step 66. The regression parameters are related to the cell's current density, single voltage, differential pressure, caustic flow and/or liquid level to estimate a pinhole's size and position. For example, if the parametric parameters of a cell resulting from a non-linear regression are considerable (i.e. estimated to be high in value), then the pinhole(s) in the membrane of the cell are (is) estimated to be relatively large in size and/or positioned in a lower part (or below a midsection) of the cell.

In step 70, a maintenance action is outputted or automatically taken on the electrolyser.

For example, the maintenance action can be taken on a cell classified as non-severely damaged, based on a pinhole position estimation or a pinhole size estimation for that cell.

If the pinhole is large and located at the upper part of the cell (where gas and/or foam is present), severe damage could occur due to the risk of Oxygen evolution in the anode compartment and/or corrosion which results from the caustic attacking the coating of the anode. The maintenance action is then taken to remove or replace the damaged membrane cells. Alternatively to removal or replacement, the cell can be deactivated and its membrane can be replaced with a new one.

As detailed hereinabove, the method as illustrated in FIG. 3*a* may be performed from start-up to full operation of the electrolyser, or from full operation to shutdown. The methods described by FIGS. 3*b* to 3*c* can be applied at start-up, shutdown or during full operation of the electrolyser.

Figure 4:
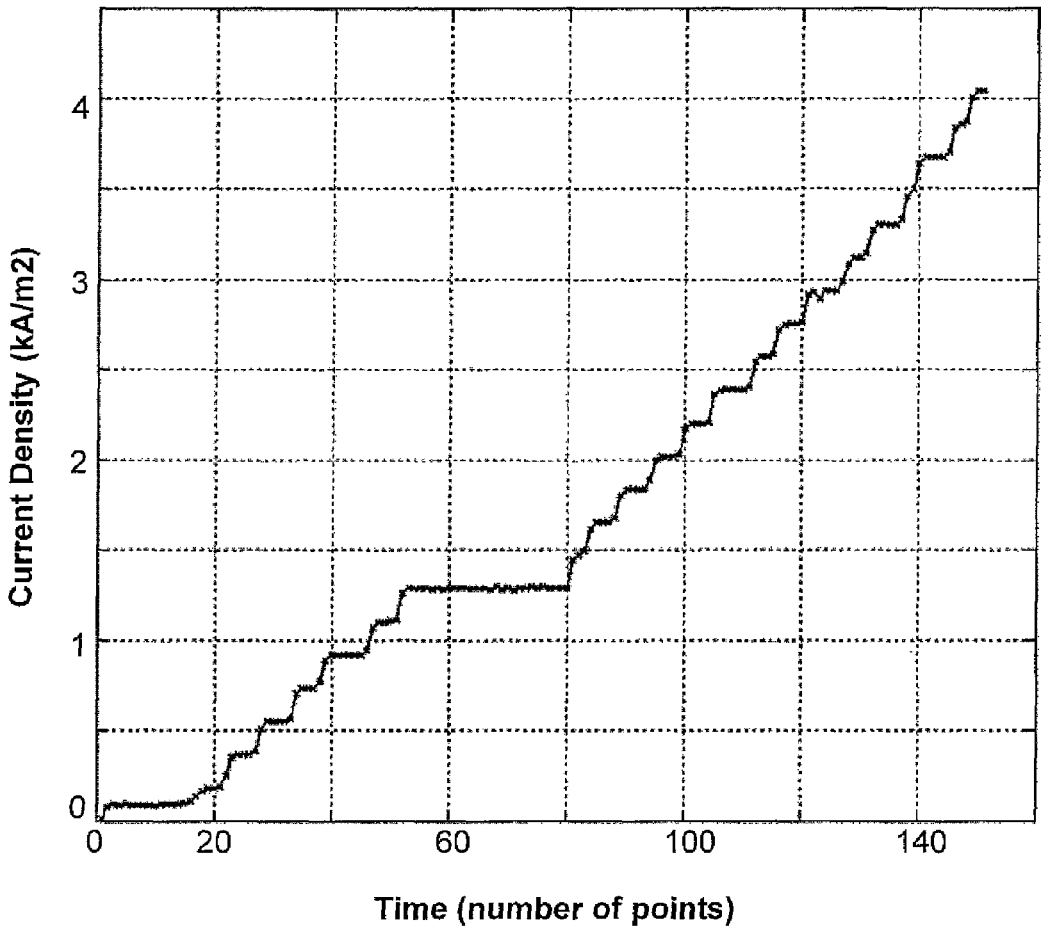
FIG. 4 is a graph showing an example of a time versus current density relationship through a start-up zone of the electrolyser.

An example of a start-up zone is depicted in FIG. 4. Typically, at start-up operation, the first step is the polarization step at current values around 20 A, then the current rises from low values to high values through stable steps, up to current densities in the order of 5.5 kA/m$^2$. The maximum current density can vary depending on the particular electrolyser design.

In steps 50 to 54 of FIG. 3*a*, the electrolyser's single elements voltage distribution (the voltage at each cell in the electrolyser) can be monitored at very low current densities within the polarization level. Cells having a voltage which is less than 2.0 V are then identified, highlighted or detected from the distribution.

FIGS. 5 to 8 illustrate an example of single elements voltage distribution evolution, as the current density flowing in each cell varies from one value to the other. These represent a start-up typical of an electrolyser comprising 100 cells.

The graphs of FIGS. 5 to 8 represent the voltages acquired for each cell, as in step 50 of FIG. 3*a*. Voltage measurement equipment having a precision in the order of 2.5 mV was used to obtain those readings. Each cell is represented by a block.

As seen from the graphs in FIGS. 5 to 8, when the polarization level of each cell has passed at start-up of the electrolyser, a voltage distribution of the cells can be established by steadily increasing the current density and taking voltage measurements continuously or at predefined steps. Though the voltage measurement can be taken for each discrete increase in current density of 0.2 kA/m$^2$ or less, FIGS. 5 to 8 were taken for current densities of 0.2 kA/m$^2$, 0.5 kA/m$^2$, 1 kA/m$^2$ and 2 kA/m$^2$ respectively.

Figure 5:
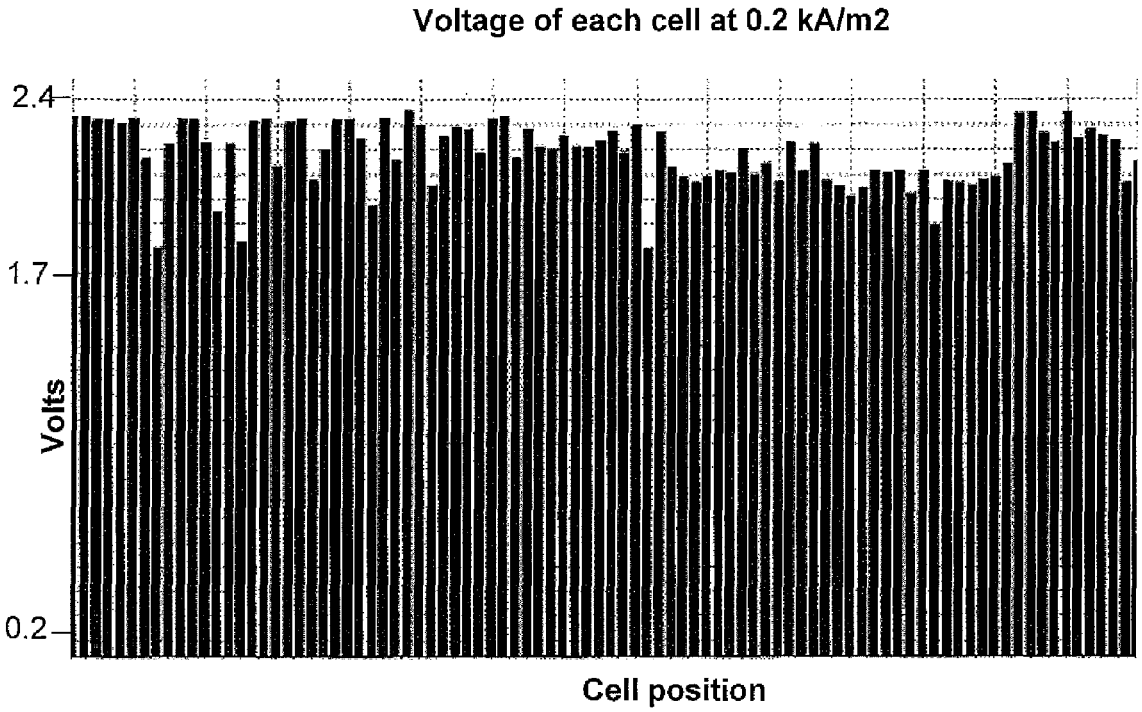
FIG. 5 is a graph which illustrates voltage distributions of multiple cells, at a current density of 0.2 kA/m$^2$, in accordance with one embodiment.

As an example, the voltage distributions obtained as illustrated in FIGS. 5 to 8 and 10 (the latter being explained in more detail below) can be thresholded as in steps 52 and 54 of FIG. 3*a*. At a current density of 0.4 kA/m$^2$ (refer to FIG. 10), cells with a voltage level lower than 1.7 V for example, are categorized as severely damaged. In FIG. 5, however, no such cell is found. Would such cells have been detected from the results in FIG. 5, these cells should be deactivated, removed or replaced by new ones or the electrolyser shutdown for maintenance, as in step 56 of FIG. 3*a*.

At a current density of 0.5 kA/m$^2$ (refer to FIG. 6), three cells present a voltage level relatively low (around 1.85 V). These three cells are classifiable as non-severely damaged and potentially have pinholes in their membrane.

Figure 6:
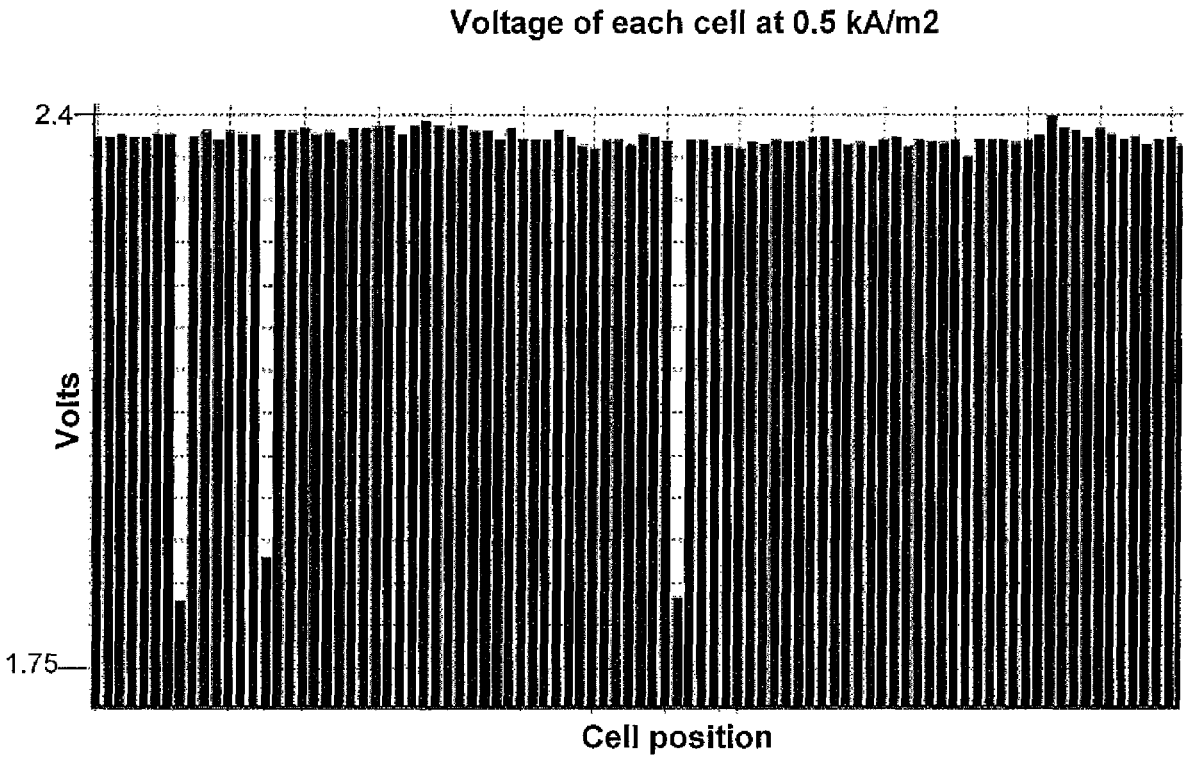
FIG. 6 is a graph which illustrates voltage distributions of the cells as in FIG. 5, at a current density of 0.5 kA/m$^2$, in accordance with one embodiment.

A non-linear regression can then be applied to the data measured for the three low-voltage cells identified in FIG. 6, as done in step 68 of FIG. 3*c*, to estimate a pinhole size and/or position in the cell.

Figure 7:
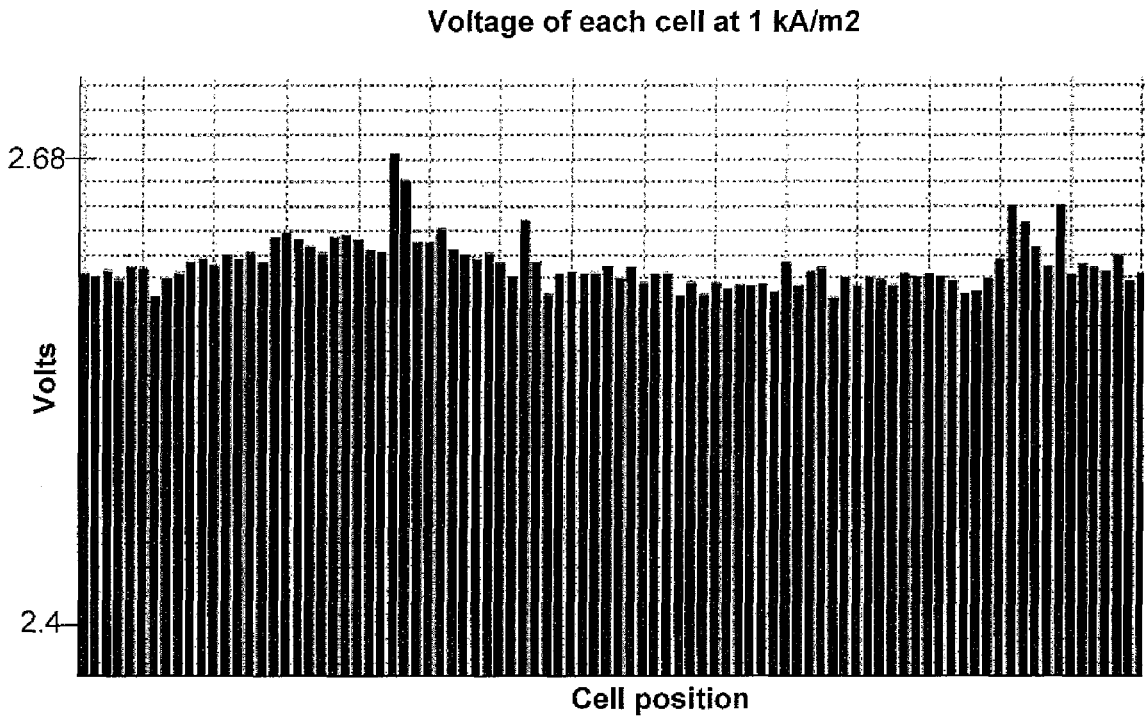
FIG. 7 is a graph which illustrates voltage distributions of the cells as in FIG. 5, at a current density of 1.0 kA/m$^2$, in accordance with one embodiment.
Figure 8:
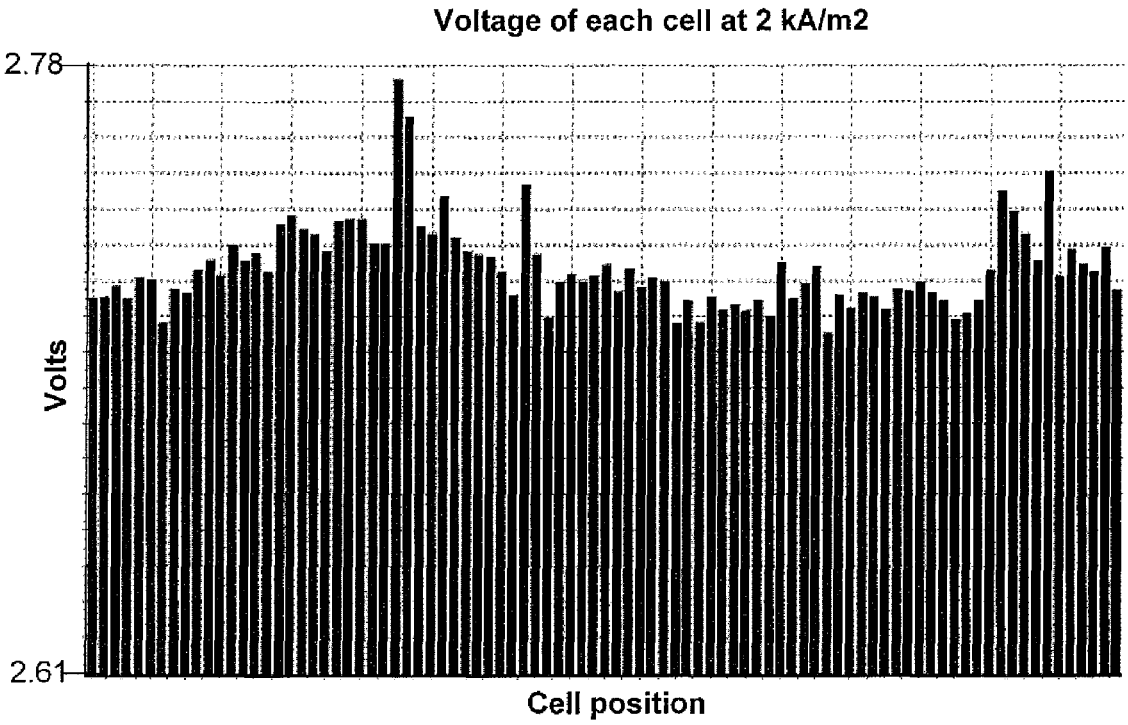
FIG. 8 is a graph which illustrates voltage distributions of the cells as in FIG. 5, at a current density of 2.0 kA/m$^2$ in accordance with one embodiment.

Voltage distributions of the remaining cells of FIG. 6, at a current density such as 1 kA/m$^2$, as shown in FIG. 7, and 2 kA/m$^2$, as shown in FIG. 8, can be further analysed to estimate their efficiencies and thereby detect cells presenting efficiency issues, as in steps 60-62 of FIG. 3*b*. For example, in FIG. 8, the two cells with the highest voltages are above average. As in step 64 of FIG. 3*b*, the position of cells presenting efficiency or performance issues may be changed to a new position in the electrolyser, in such a way as to compensate for any lower cell efficiency. In the example of FIG. 8, the two cells having the highest voltages can be repositioned in the electrolyser at a beginning or an end of a production line 18 or cell grouping 19 (refer to FIG. 1*b*) for example.

Figure 9:
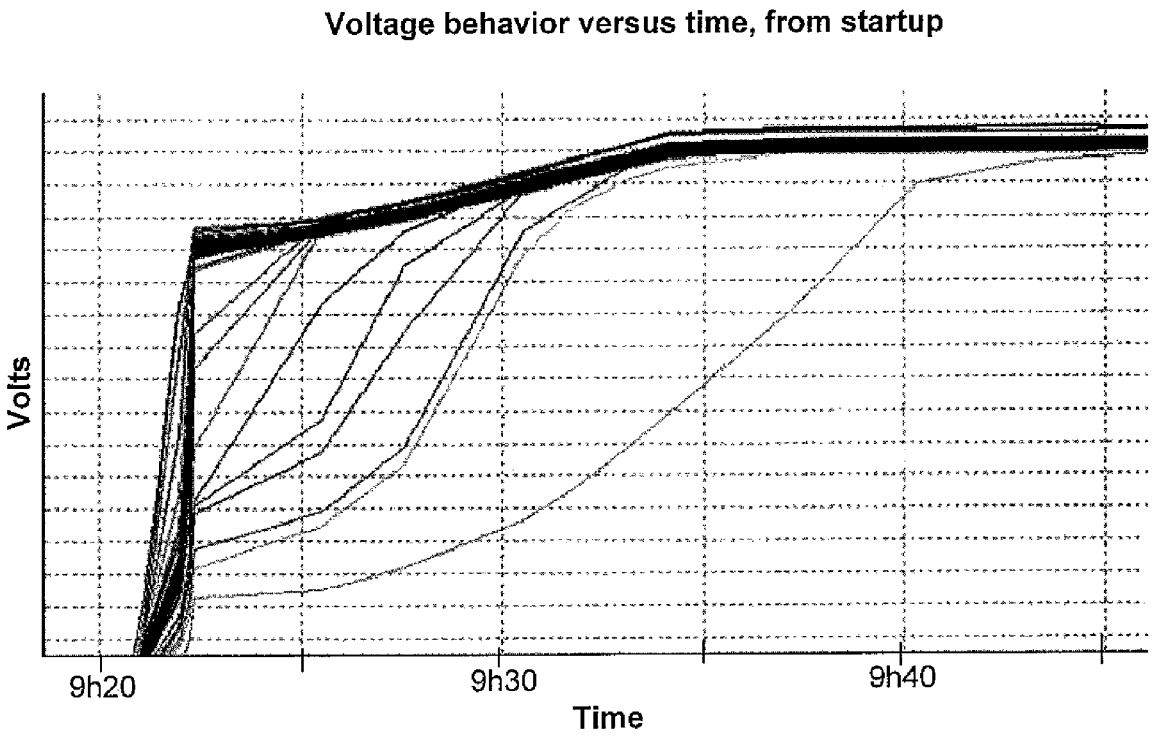
FIG. 9 is a graph showing voltage versus time behaviours of multiple cells, from start-up of the electrolyser, each line representing a behaviour of one cell, in accordance with one embodiment.

FIG. 9 shows a graph showing an example of voltage versus time behaviours for cells classified as non-severely damaged, after start-up of the electrolyser. Such a graph could result from the implementation of the above step 50 in FIG. 3*a*, when the acquisition is done through a start-up zone. Each line represents the behaviour of one cell.

Figure 10:
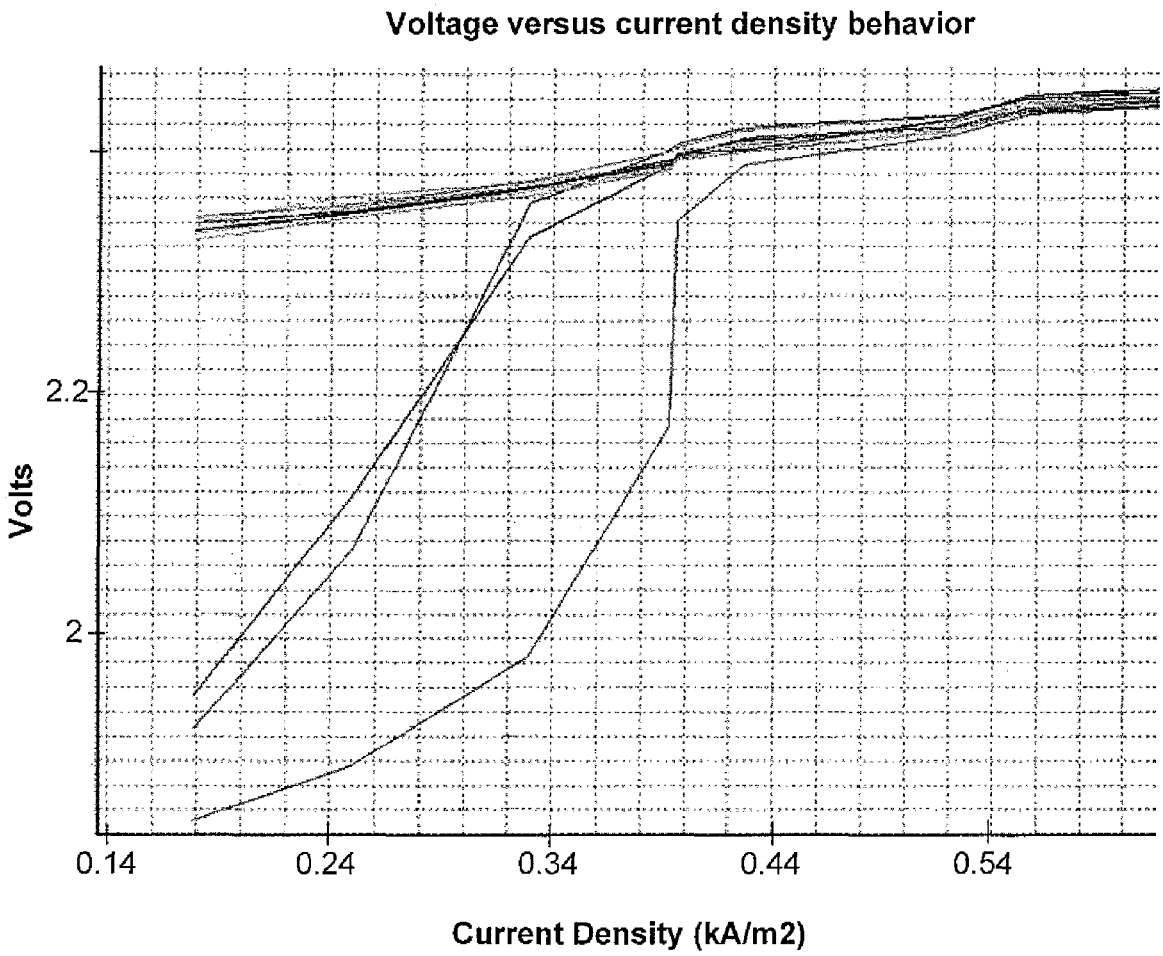
FIG. 10 is a graph showing voltage versus current density behaviours of multiple cells, each line representing a behaviour of one cell, in accordance with one embodiment.

FIG. 10 is a graph showing voltage versus current density behaviours of multiple cells. Again, each line represents a behaviour of one cell. Such a graph can also be obtained from the implementation of the above step 50 in FIG. 3*a*, or by combining multiple readings such as illustrated in FIGS. 5 to 8. In FIG. 10, severely damaged cells are identifiable by their typically low voltage at low current densities. A voltage threshold is used in step 52 to distinguish severely damaged cells from non-severely damaged cells by classifying the output voltage levels of each cell at low current densities. In one embodiment, the lowest curve is classified as severely damaged, while the two middle curves are classified as non-severely damaged. The exact voltage levels used in the classification are dependent upon the specific cell and electrolyser configuration used.

The above embodiments are exemplary only and can be adapted to various specific applications. For example, the various sensors involved can be made dependant on the particular physical parameters to be measured, and the classification of the cells according to their damage level can vary upon cell design, production plant design and electrolyser design. The following claims are intended to define the scope of the invention.

The invention claimed is:

1. A method for evaluating damage of a plurality of cells in an electrolyser, the method comprising:

acquiring a voltage for each one of the cells;

comparing the voltage to at least two threshold voltage levels;

classifying the cells as one of: severely damaged cells, non-severely damaged cells and undamaged cells, based on the comparison of the voltage with the at least two threshold voltage levels; and deactivating the cells classified as severely damaged cells from the electrolyser.

2. The method of claim 1, wherein the acquiring a voltage comprises acquiring a voltage versus current distribution for each one of the cells at one of startup and shutdown of the electrolyser.

3. The method of claim 1, further comprising:

acquiring a temperature and a current distribution of one of the undamaged cells and the non-severely damaged cells; and estimating an efficiency of each one of the cells.

4. The method of claim 3, further comprising maximizing an overall efficiency of the electrolyser by moving at least one of the cells that have not been deactivated to a new position in the electrolyser.

5. The method of claim 4, wherein the estimating an efficiency comprises comparing the temperature and the current distribution of each one of the cells with nominal cell parameters.

6. The method of claim 2, further comprising:

measuring a physical parameter of each one of the cells classified as non-severely damaged cells; and estimating at least one of a position and a size of a pinhole in a membrane of each one of the non-severely damaged cells using the physical parameter measured.

7. The method of claim 6, wherein the estimating at least one of a position and a size of a pinhole comprises:

applying a regression to the voltage versus current distribution acquired for each one of the non-severely damaged cells; and correlating the regression with the physical parameter measured.

8. The method of claim 6, further comprising taking a maintenance action on any one of the non-severely damaged cells based on the at least one of the position and the size estimated for that one of the non-severely damaged cells.

9. The method of claim 6, wherein the estimating at least one of a position and a size of a pinhole comprises evaluating a caustic flow penetrating an anodic compartment of one of the non-severely damaged cells by traversing the membrane.

10. The method of claim 6, wherein the physical parameter is one of a differential pressure and a liquid level in the cell.

11. The method of claim 10, wherein the estimating of a position of a pinhole comprises comparing at least one of the differential pressure and the liquid level with an expected value to determine whether the position is one of above, below and at a midsection of the cell.

12. A system for evaluating damage of a plurality of cells in an electrolyser, the system comprising:

a voltage acquisition device coupled to each one of the cells in the electrolyser, for acquiring a voltage for each one of the cells; and a damage evaluation module coupled to the voltage acquisition device, the damage evaluation module adapted to receive the voltage acquired for each one of the cells; compare the voltage to at least two threshold voltage levels; classify the cells as being one of: severely damaged cells, non-severely damaged cells and undamaged cells, based on the comparison;

and send a signal to deactivate the cells classified as severely damaged cells.

13. The system of claim 12, further comprising a memory device coupled to the voltage acquisition device and the damage evaluation module for storing the voltage acquired for each one of the cells and the at least two threshold voltage levels.

14. The system of claim 12, wherein the voltage acquisition device comprises a current controlling device for acquiring a voltage versus current distribution for each one of the cells, the current controlling device varying a current in each one of the cells at one of startup and shutdown of the electrolyser.

15. The system of claim 14, further comprising:

a temperature sensor and a current sensor for acquiring a temperature and a current distribution of each one of the cells classified as one of undamaged cells and non-severely damaged cells; and a cell efficiency evaluation module for estimating an efficiency of each one of the cells.

16. The system of claim 15, further comprising an electrolyser maintenance module adapted to receive the efficiency of each one of the cells and indicate an action to be performed for adjusting an overall efficiency of the electrolyser.

17. The system of claim 16, further comprising a processing module for comparing the temperature and the current distribution acquired for each one of the cells with nominal cell parameters.

18. The system of claim 12, further comprising a sensor for measuring a physical parameter of each one of the cells classified as non-severely damaged cells, and a processing module for estimating at least one of a position and a size of a pinhole in a membrane of each one of, the non-severely damaged cells using the physical parameter measured and the voltage acquired for each one of the non-severely damaged cells.

19. The system of claim 18, further comprising an electrolyser maintenance module adapted to transmit a signal representative of a maintenance action to be performed on any one of the non-severely damaged cells, the maintenance action being based on the at least one of the position and the size of a pinhole estimated for that one of the non-severely damaged cells.

20. The system of claim 19, wherein the sensor comprises a flow sensor for measuring a caustic flow in each one of the non-severely damaged cells, the caustic flow penetrating an anodic compartment by traversing the membrane.

21. The system of claim 20, wherein the sensor comprises one of a differential pressure sensor and a liquid sensor for measuring a level of liquid in a cell.

22. The system of claim 21, wherein the processing module compares at least one of the physical parameter measured by the differential pressure sensor and the liquid sensor with an expected value to determine whether the position of the pinhole is one of above, below and at a midsection of the cell.

* * * * *